US010156407B2

(12) United States Patent
Delgado Acarreta et al.

(10) Patent No.: US 10,156,407 B2
(45) Date of Patent: Dec. 18, 2018

(54) CARTRIDGE-IN-CHAMBER DETECTION SYSTEM FOR FIREARMS

(71) Applicant: Rade Tecnologías, S.L., Saragossa (ES)

(72) Inventors: Raúl Delgado Acarreta, Saragossa (ES); Rubén Robles Pérez, Saragossa (ES); Javier Atrian Blasco, Saragossa (ES); Diego Bernal Somavilla, Saragossa (ES); Diego Ibáñez Martínez, Saragossa (ES); José Cuesta Álvarez, Saragossa (ES)

(73) Assignee: RADE TECNOLOGÍAS, S.L., Saragossa (ES)

( * ) Notice: Subject to any disclaimer, the term of this patent is extended or adjusted under 35 U.S.C. 154(b) by 0 days.

(21) Appl. No.: 15/645,642

(22) Filed: Jul. 10, 2017

(65) Prior Publication Data

US 2018/0023908 A1 Jan. 25, 2018

(30) Foreign Application Priority Data

Jul. 11, 2016 (ES) ..... 201630942

(51) Int. Cl.
*F41A 9/53* (2006.01)

(52) U.S. Cl.
CPC ..... *F41A 9/53* (2013.01)

(58) Field of Classification Search
CPC ..... F41A 9/53
USPC ..... 42/1.01, 1.02, 1.05
See application file for complete search history.

(56) References Cited

U.S. PATENT DOCUMENTS

| | | | | |
|---|---|---|---|---|
| 3,024,453 | A * | 3/1962 | Ransom | F41A 9/53 324/179 |
| 4,275,521 | A * | 6/1981 | Gerstenberger | F41A 19/58 42/84 |
| 5,755,056 | A | 5/1998 | Danner et al. | |
| 8,464,451 | B2 * | 6/2013 | McRae | F41A 17/06 42/1.01 |
| 2004/0107620 | A1 * | 6/2004 | Haefeli | F41A 17/06 42/1.05 |
| 2010/0139141 | A1 | 6/2010 | Pikielny | |

FOREIGN PATENT DOCUMENTS

| | | |
|---|---|---|
| EP | 0276843 | 8/1988 |
| WO | 2016113455 | 7/2016 |
| WO | 2016113437 | 7/2017 |

* cited by examiner

*Primary Examiner* — Stephen Johnson
(74) *Attorney, Agent, or Firm* — Conley Rose PC

(57) ABSTRACT

The present invention relates to a cartridge-in-chamber detection system for firearms which makes it possible to reliably detect the presence or non-presence of a cartridge in the chamber whilst making it possible to supply this information to the user intuitively and comprising at least two plates wherethrough it is possible to determine the variation of the electrical capacity between two possible states of the system, when there is no cartridge in the chamber and when there is a cartridge in the chamber.

20 Claims, 6 Drawing Sheets

CARTRIDGE-IN-CHAMBER DETECTION SYSTEM FOR FIREARMS

OBJECT OF THE INVENTION

The present invention relates to a cartridge-in-chamber detection system for firearms which makes it possible to reliably detect the presence or non-presence of a cartridge in the chamber whilst making it possible to supply this information to the user intuitively.

The object of the present invention is a cartridge-in-chamber detection system for firearms comprising at least two plates wherethrough it is possible to determine the variation in the electrical capacity between two possible states of the system, when there is no cartridge in the chamber and when there is a cartridge in the chamber.

BACKGROUND OF THE INVENTION

In practically all of the weapons currently in existence, the cartridge must be housed in the chamber before it is possible to open fire. Thus, in terms of safety, the existence of the cartridge in the chamber is the most critical situation, since having a cartridge housed in the chamber makes it possible to immediately open fire.

The weapon user is always responsible for knowing the state of the weapon chamber. Uncertainty about the existence of a cartridge in the chamber inherently entails lack of safety and can lead to serious accidents.

Some of the most widely used weapons incorporate mechanical indicators visible from the shooting position that inform of the chamber situation. However, in conditions when light is lacking it may be difficult to determine the presence of a cartridge in the chamber by observing said mechanical indicators, so that the uncertainty associated with the presence or non-presence of a cartridge in the chamber entails even greater risks than the uncertainty itself.

Systems are known in the state of the art that make it possible to control an electric weapon detecting the presence of a cartridge in the chamber, where said systems have means to, through a supply voltage, determine the impedance of a cartridge in two possible states of the system, when there is no cartridge in the chamber and when there is a cartridge in the chamber, making use of two plates.

The previous systems include that disclosed in patent U.S. Pat. No. 5,755,056 A relating to an electronic weapon and to the process to control said weapon, where the plates are positioned to electrically contact with conductive portions of the ammunition cartridge, means to supply current to at least one of the plates, means to measure the resistance between the plates and means to compare the resistance measured with at least one reference.

The system disclosed in the previous patent comprises a comparator circuit to detect the presence of a cartridge, and in particular to detect ammunition which may be electrically fired. The circuit is formed by the contacts between the plates and a cartridge. If there is a cartridge between the two plates, the current of one of the plates is transmitted, which may be a firing pin, through the cartridge, to the second plate which may be the weapon barrel.

However, the measurement of the impedance may be affected by the user's presence, since the measurement may be distorted depending on whether the user comes into contact with metal parts of the weapon or not.

The cartridge-in-chamber detection system for firearms of the present invention has a configuration which makes it possible to resolve all the aforementioned drawbacks, providing a system which is independent of the situation where the user comes into contact with metal parts of the weapon or not.

DESCRIPTION OF THE INVENTION

The present invention relates to a cartridge-in-chamber detection system for firearms which makes it possible to reliably detect the presence or non-presence of a cartridge in the chamber whilst making it possible to supply this information to the user intuitively.

The cartridge-in-chamber detection system for firearms comprises at least one first plate, a second plate and a dielectric disposed between the first plate and the second plate, and a sensor circuit connected to a microprocessor, where the at least first plate is displaceable or the dielectric varies between a first position corresponding to the presence of a cartridge in the chamber and a second position corresponding to the non-presence of a cartridge in the chamber, or vice-versa.

The microprocessor, through the sensor circuit, detects the capacitive variation between the first plate and the second plate, between the first position corresponding to the presence of a cartridge in the chamber and the second position corresponding to the non-presence of a cartridge in the chamber, or vice-versa, making it possible to determine in this way the presence or non-presence of a cartridge in the chamber.

Optionally, the cartridge-in-chamber detection system for firearms further comprises a movement sensor which activates the cartridge detection system when the weapon is subject to any type of movement.

Optionally, the cartridge-in-chamber detection system for firearms further comprises a light indicator which indicates to the user the presence or non-presence of a cartridge in the chamber where the light indicator is visible from the user's shooting position without taking his eyes off the target, and where the light intensity is sufficient to be seen by the user in high luminosity conditions, but not excessive so as to dazzle the user.

Optionally, one of the plates is disposed on the sensor circuit connected to the microprocessor.

Preferably, in the first position corresponding to the presence of a cartridge in the chamber, the first plate is closer to the second plate than in the second position corresponding to the non-presence of a cartridge in the chamber, and therefore the capacity associated to the first position is greater than the capacity associated to the second position.

Alternatively, in the first position corresponding to the presence of a cartridge in the chamber, the first plate is further from the second plate than in the second position corresponding to the non-presence of a cartridge in the chamber, and therefore the capacity associated to the first position is less than the capacity associated to the second position.

Also preferably, in the first position corresponding to the presence of a cartridge in the chamber, the opposing area between the first plate and the second plate is greater than in the second position corresponding to the non-presence of a cartridge in the chamber, and therefore the capacity associated to the first position is greater than the capacity associated to the second position.

Alternatively, in the first position corresponding to the presence of a cartridge in the chamber, the opposing area between the first plate and the second plate is less than in the second position corresponding to the non-presence of a cartridge in the chamber, and therefore the capacity associated to the first position is less than the capacity associated to the second position.

Also preferably, in the first position corresponding to the presence of a cartridge in the chamber, the dielectric varies between the first plate and the second plate with respect to the second position corresponding to the non-presence of a cartridge in the chamber, and therefore the capacity associated to the first position is different to the capacity associated to the second position.

In this way, the cartridge-in-chamber detection system for firearms of the present invention makes it possible to determine the capacity between the first plate and the second plate, between the first position corresponding to the presence of a cartridge in the chamber and the second position corresponding to the non-presence of a cartridge in the chamber, or vice-versa.

Furthermore, as there is no contact between the first plate and the second plate it avoids wear of the parts, which, as they are subjected to great stresses or friction when a shot is fired, may suffer deformations, in addition to preventing the appearance of dirt as there is no continuous contact between parts.

The sensor circuit makes it possible to convert the capacitive variation in a voltage variation.

When the system attempts to detect if there is a cartridge in the chamber, the microprocessor generates a signal whereby the capacity of the sensor circuit is charged, which in turn depends on the status of the system and it is possible to measure the variations in capacity of the sensor circuit.

Optionally, the first plate and/or the second plate may be an element belonging to the weapon, a modified element belonging to the weapon or an element external to the weapon.

Optionally, the first plate and/or the second plate may be displaceable or fixed.

Optionally, the first plate and/or the second plate is/are located outside the chamber.

Thus formed, the cartridge-in-chamber detection system for firearms of the present invention has the following advantages with respect to the systems with mechanical indicators visible from the shooting position which inform of the chamber situation. These advantages are as follows:

- The information may be shown in a much more intuitive way by means of the light indicator which indicates to the user the presence or non-presence of a cartridge in the chamber.
- As it has a movement sensor, the information is supplied at the appropriate time, avoiding dangerous situations.
- The light indicator is much more visible than the position of the mechanical indicator and the user does not have to take his eyes off it to receive the information in a shooting position.
- The information may be received in low-light conditions.

PREFERRED EMBODIMENT OF THE INVENTION

Below, the cartridge-in-chamber detection system for firearms of the present invention is described in detail.

Figure 1:
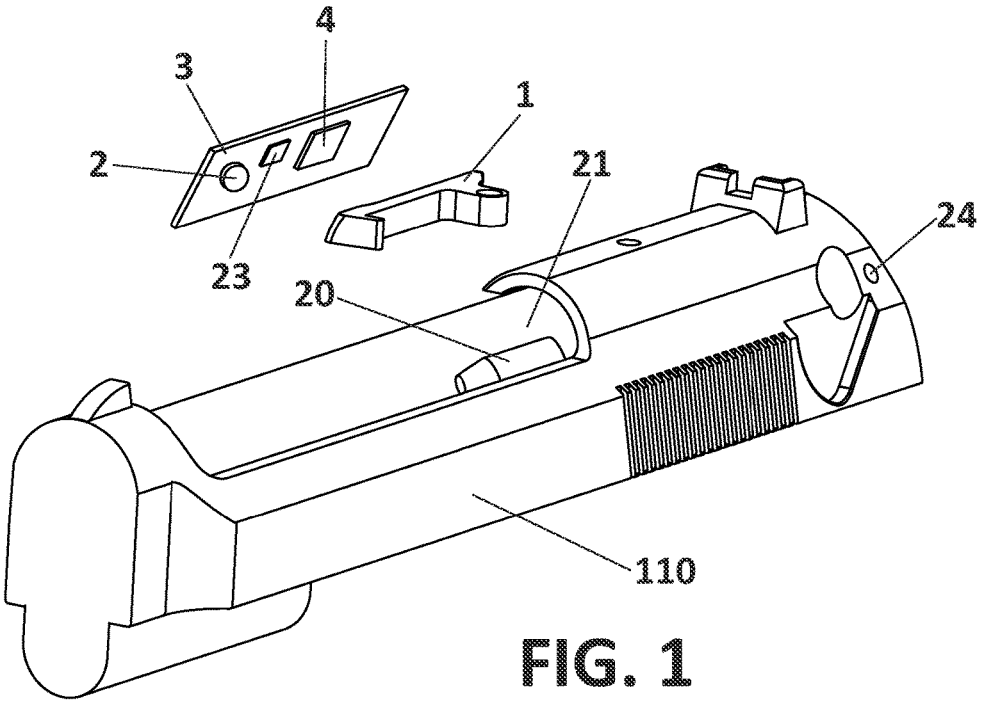
FIG. 1 shows an exploded perspective view of the cartridge-in-chamber detection system for firearms of the present invention according to a first example of embodiment.
Figure 2:
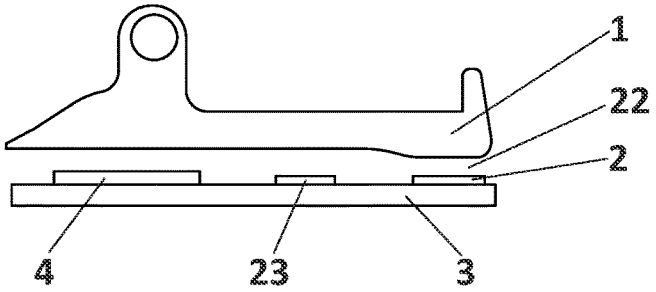
FIG. 2 shows a detail of the cartridge-in-chamber detection system for firearms of the present invention in the first position corresponding to the presence of a cartridge in the chamber according to the first example of embodiment.
Figure 3:
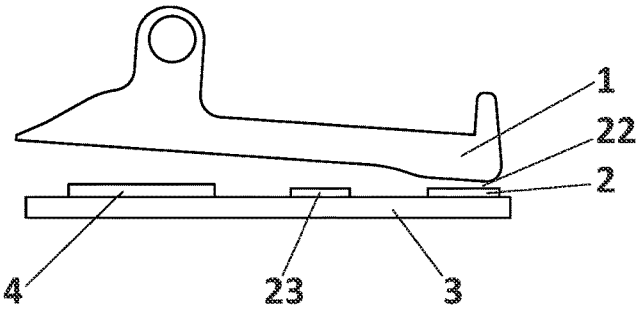
FIG. 3 shows a detail of the cartridge-in-chamber detection system for firearms of the present invention in the second position corresponding to the non-presence of a cartridge in the chamber according to the first example of embodiment.

In a first example of embodiment shown in FIGS. 1 to 3, the system comprises a first plate (1), which in this example of embodiment corresponds to an extractor of the weapon which is in contact with a cartridge (20), a second plate (2), a dielectric (22) disposed between the first plate (1) and the second plate (2) and a sensor circuit (3) connected to a microprocessor (4), where the first plate (1) or extractor is displaceable between a first position corresponding to the presence of a cartridge (20) in the chamber (21) and a second position corresponding to the non-presence of a cartridge (20) in the chamber(21).

The microprocessor (4), through the sensor circuit (3) detects the capacitive variation between the first plate (1) or extractor and the second plate (2), between the first position corresponding to the presence of a cartridge (20) in the chamber (21) and the second position corresponding to the non-presence of a cartridge (20) in the chamber (21), making it possible to determine in this way the presence or non-presence of a cartridge (20) in the chamber (21).

The second plate (2) is disposed on the sensor circuit (3) connected to the microprocessor (4).

In the first position corresponding to the presence of a cartridge (20) in the chamber (21), the first plate (1) or extractor is closer to the second plate (2) disposed on the sensor circuit (3) than in the second position corresponding to the non-presence of a cartridge (20) in the chamber (21), and therefore the capacity associated to the first position is greater than the capacity associated to the second position.

In this first example of embodiment, the first plate (1) or extractor is an element belonging to the weapon and the second plate (2) is an element external to the weapon.

In this first example of embodiment, the first plate (1) or extractor and the second plate (2) are located outside the chamber (21).

Figure 4:
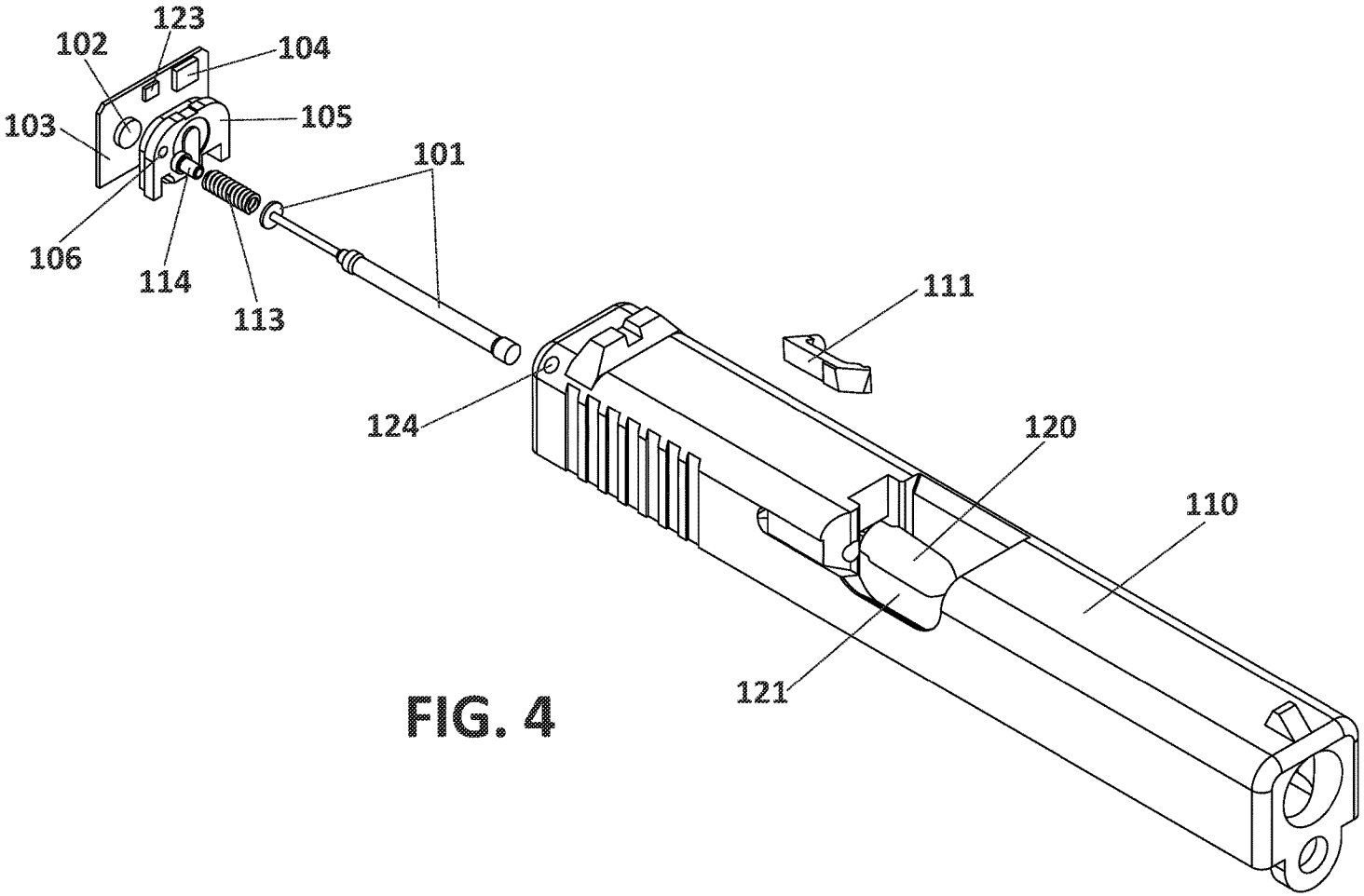
FIG. 4 shows an exploded perspective view of the cartridge-in-chamber detection system for firearms of the present invention according to a second example of embodiment.
Figure 5A:
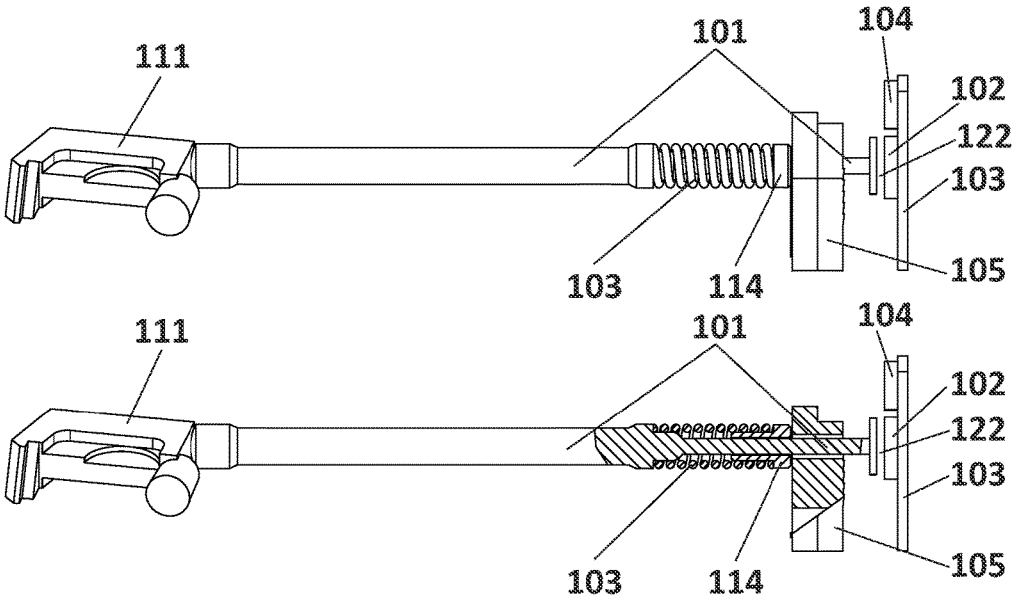
FIG. 5*a* shows a view of a detail with cartridge in the chamber of the second example of embodiment shown in FIG. 4.
Figure 5B:
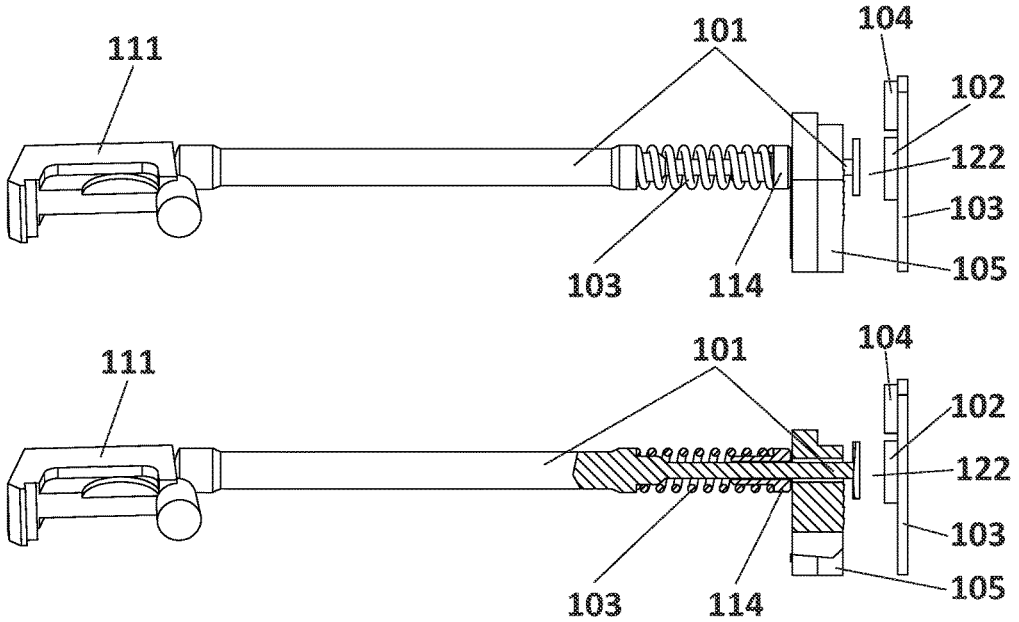
FIG. 5*b* shows a view of a detail without cartridge in the chamber of the second example of embodiment shown in FIG. 4.

In a second example of embodiment shown in FIGS. 4, 5*a* and 5*b*, the system comprises a first plate (101) or plunger disposed in a slide (110) of the weapon, a second plate (102), a dielectric (122) disposed between the first plate (101) and the second plate (102) and a sensor circuit (103) connected to a microprocessor (104), where the first plate (101) or plunger is displaceable between a first position corresponding to the presence of a cartridge (120) in the chamber (121) and a second position corresponding to the non-presence of a cartridge (120) in the chamber (121).

The microprocessor (104), through the sensor circuit (103), detects the capacitive variation between the first plate (101) or plunger and the second plate (102), between the first position corresponding to the presence of a cartridge (120) in the chamber (121) and the second position corresponding to the non-presence of a cartridge (120) in the chamber (121), making it possible to determine in this way the presence or non-presence of a cartridge (120) in the chamber (121).

The first plate (101) or plunger is in contact with an extractor (111) of the weapon, where the first plate (101) or plunger is disposed in the slide (110) of the weapon. The first plate (101) or plunger passes through a support piece (114) of an elastic element (113) which maintains the tension on the first plate (101) or plunger. Preferably, the first plate (101) or plunger, the support piece (114) and the elastic element (113) are disposed in the longitudinal direction of the slide (110) of the weapon.

When a cartridge (120) is in the chamber (121), the extractor (111) pushes the first plate (101) or plunger towards the outside of a closure piece (105) through an orifice (106) thereof.

The second plate (102) is disposed on the sensor circuit (103) connected to the microprocessor (104).

In the first position corresponding to the presence of a cartridge (120) in the chamber (121), the first plate (101) or plunger is closer to the second plate (102) disposed on the sensor circuit (103) than in the second position corresponding to the non-presence of a cartridge (120) in the chamber (121), and therefore the capacity associated to the first position is greater than the capacity associated to the second position.

In this second example of embodiment, the first plate (101) or plunger is a modified element belonging to the weapon and the second plate (102) is an element external to the weapon.

In this second example of embodiment, the first plate (101) or plunger and the second plate (102) are located outside the chamber (121).

Figure 6:
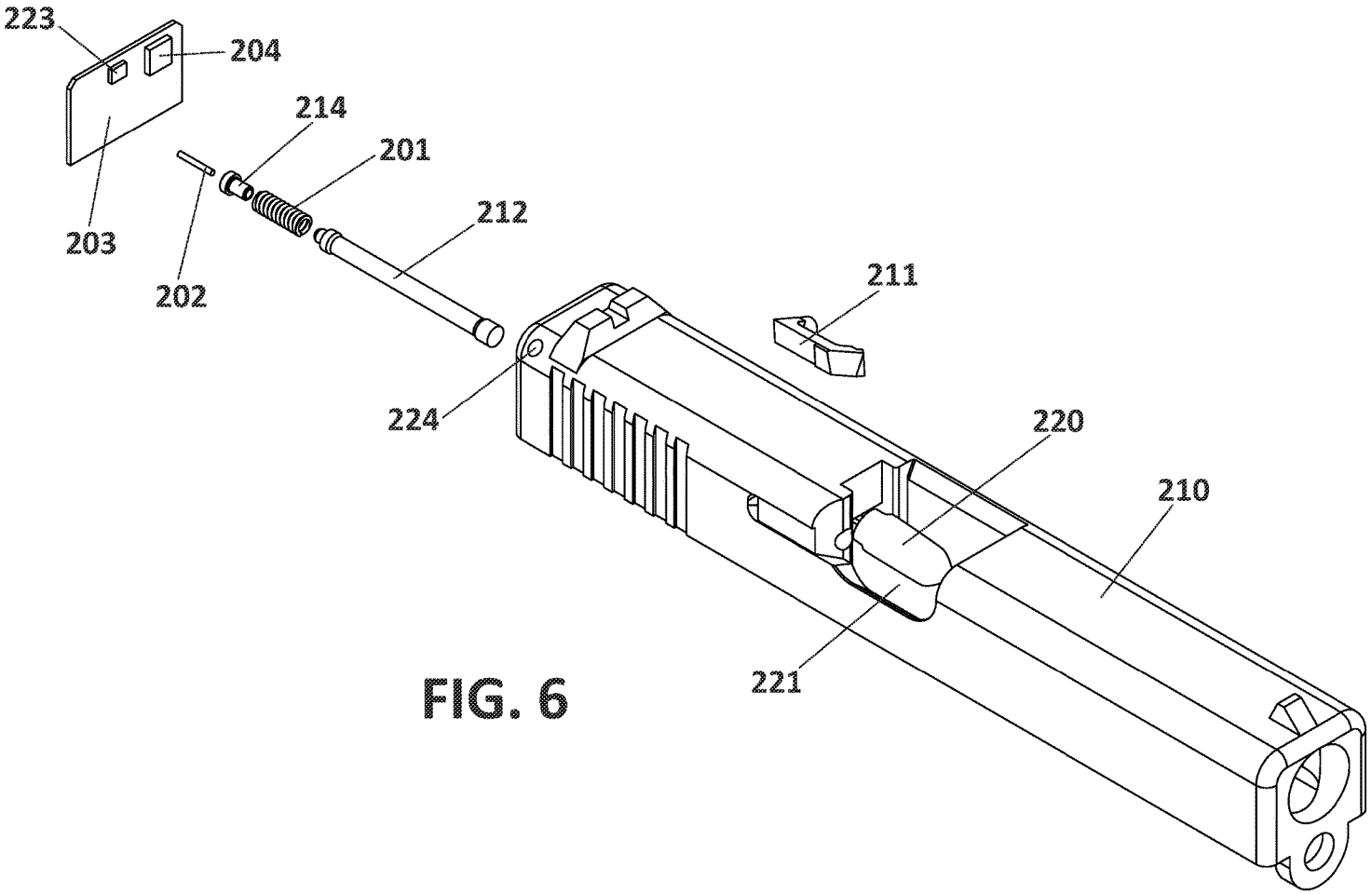
FIG. 6 shows an exploded perspective view of the cartridge-in-chamber detection system for firearms of the present invention according to a third example of embodiment.
Figure 7A:
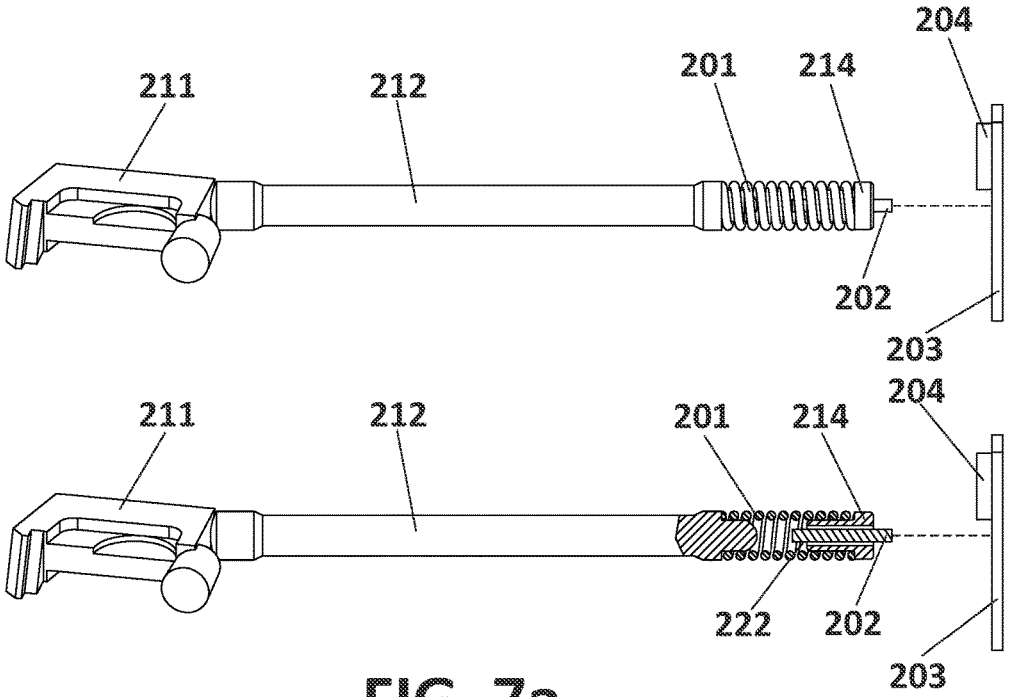
FIG. 7*a* shows a view of a detail with cartridge in the chamber of the third example of embodiment shown in FIG. 6.
Figure 7B:
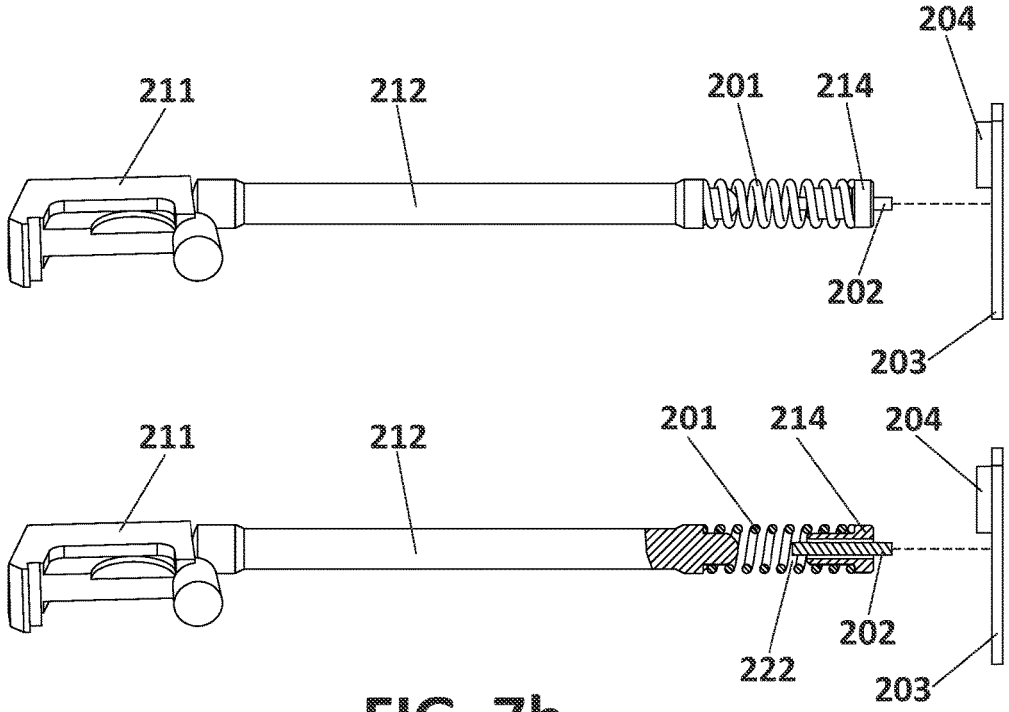
FIG. 7*b* shows a view of a detail without cartridge in the chamber of the third example of embodiment shown in FIG. 6.

In a third example of embodiment shown in FIGS. 6, 7*a* and 7*b*, the system comprises a first plate (201) disposed in a slide (210) of the weapon, a second plate (202) disposed on the slide (210) of the weapon, a dielectric (222) disposed between the first plate (201) and the second plate (202) and a sensor circuit (203) connected to a microprocessor (204), where the first plate (201) is displaceable between a first position corresponding to the presence of a cartridge (220) in the chamber (221) and a second position corresponding to the non-presence of a cartridge (220) in the chamber (221).

The microprocessor (204), through the sensor circuit (203), detects the capacitive variation between the first plate (201) and the second plate (202), between the first position corresponding to the presence of a cartridge (220) in the chamber (221) and the second position corresponding to the non-presence of a cartridge (220) in the chamber (221), making it possible to determine in this way the presence or non-presence of a cartridge (220) in the chamber (221).

The system further comprises a plunger (212) in contact with an extractor (211) of the weapon, where the plunger (212) is disposed in the slide (210) of the weapon, and where the first plate (201) is an elastic element which is in contact with the plunger (212) and maintains the tension on the plunger (212) as it is in contact with a support piece (214) which is disposed inside the first plate (201) or elastic element, where the second plate (202) is disposed inside the support piece (214).

Preferably, the first plate (201) or elastic element, the plunger (212), the support piece (214) and the second plate (202) are disposed in the longitudinal direction of the slide (210) of the weapon.

In the first position corresponding to the presence of a cartridge (220) in the chamber (221), the extractor (211) pushes the plunger (212) and in consequence compresses the first plate (201) or elastic element towards the support piece (214), so that the capacity between the number of turns of the first plate (201) or elastic element that are opposite the second plate (202) disposed inside the support piece (214) is greater than in the second position corresponding to the non-presence of a cartridge (220) in the chamber (221).

In this third example of embodiment, the first plate (201) or elastic element is an element belonging to the weapon and the second plate (202) is an element external to the weapon.

In this third example of embodiment, the first plate (201) and the second plate (202) are located outside the chamber (221).

Figure 8:
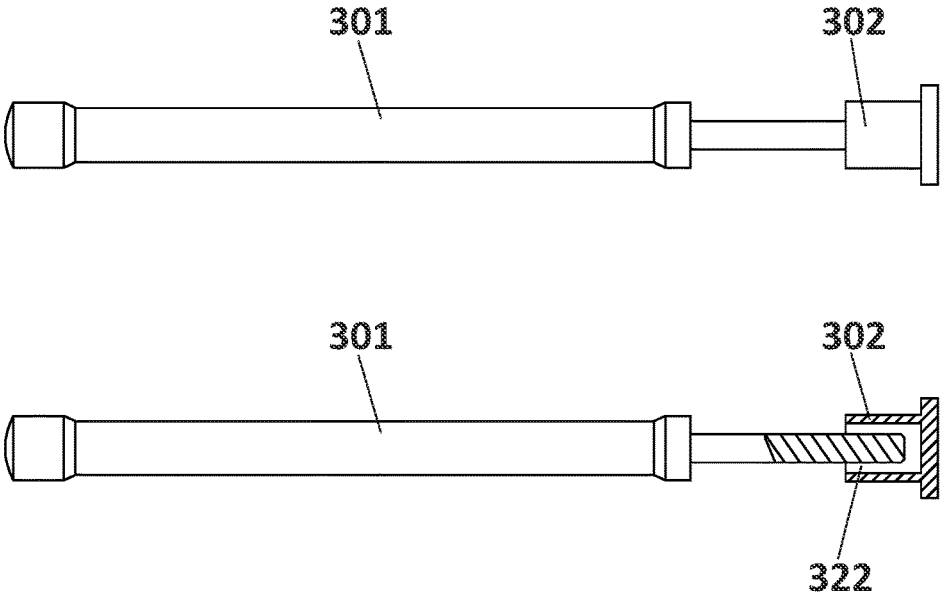
FIG. 8 shows a detail of the cartridge-in-chamber detection system for firearms of the present invention in the first position corresponding to the presence of a cartridge in the chamber according to a fourth example of embodiment.
Figure 9:
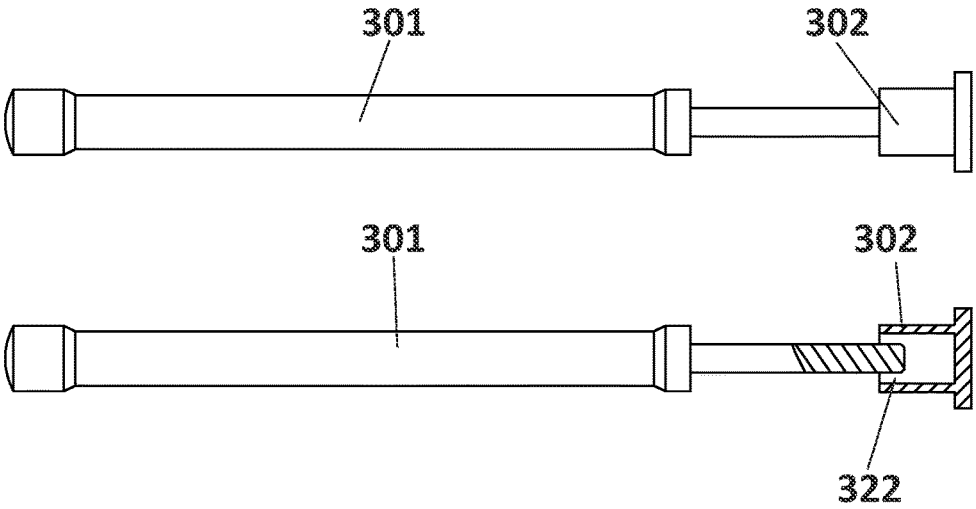
FIG. 9 shows a detail of the cartridge-in-chamber detection system for firearms of the present invention in the second position corresponding to the non-presence of a cartridge in the chamber according to the fourth example of embodiment.

In a fourth example of embodiment shown in FIGS. 8 and 9, the first plate (101) or plunger of the second example of embodiment becomes a first plate (301) with cylinder shape, whilst the support piece (114) of the second example of embodiment becomes a second plate (302) with hollow cylinder shape, second plate (302) which is the support piece of an elastic element (not shown) which maintains the tension on the first plate (301) with cylinder shape, so that two opposing plates (301, 302) are generated, whose capacity depends on the opposing area between the two plates (301, 302). A dielectric (322) is disposed between the first plate (301) and the second plate (302).

Optionally, for any of the embodiments disclosed above, the cartridge-in-chamber detection system for firearms further comprises a movement sensor (23, 123, 223) which activates the cartridge detection system when the weapon is subject to any type of movement.

Optionally, for any of the embodiments disclosed above, the cartridge-in-chamber detection system for firearms further comprises a light indicator (24, 124, 224) which indicates to the user the presence or non-presence of a cartridge (20, 120, 220) in the chamber (21, 121, 221) where the light indicator (24, 124, 224) is visible from the user's shooting position without taking his eyes off the target, and where the light intensity is sufficient to be seen by the user in high luminosity conditions, but not excessive so as to dazzle the user.

The invention claimed is:

1. Cartridge-in-chamber detection system for firearms comprising at least one first plate, a second plate and a dielectric disposed between the first plate and the second plate, and a sensor circuit connected to a microprocessor where the at least one first plate is displaceable or the dielectric varies, between a first position corresponding to a presence of a cartridge in a chamber and a second position corresponding to a non-presence of the cartridge in the chamber, or vice-versa, and where the microprocessor, through the sensor circuit, detects a capacitive variation between the first plate and the second plate, between the first position corresponding to the presence of the cartridge in the chamber and the second position corresponding to the non-presence of the cartridge in the chamber, or vice-versa, making possible to determine in this way the presence or non-presence of the cartridge in the chamber.

2. The system of claim 1, further comprising a movement sensor which activates the system when a weapon is subject to a movement.

3. The system of claim 1, further comprising a light indicator which indicates to a user the presence or the non-presence of the cartridge in the chamber.

4. The system of claim 1, where the second plate is disposed on the sensor circuit connected to the microprocessor.

5. The system of claim 1, where the first plate is an extractor of a weapon.

6. The system of claim 1, where in the first position corresponding to the presence of the cartridge in the chamber, the first plate is closer to the second plate than in the second position corresponding to the non-presence of the cartridge in the chamber, and therefore a capacity associated to the first position is greater than a capacity associated to the second position, or where in the first position corresponding to the presence of the cartridge in the chamber, the first plate is further from the second plate than in the second position corresponding to the non-presence of the cartridge in the chamber, and therefore the capacity associated to the first position is less than the capacity associated to the second position.

7. The system of claim 1, where the first plate is an element belonging to a weapon and the second plate is an element external to the weapon.

8. The system of claim 1, where the first plate is a plunger disposed in a slide of a weapon, said plunger which is in contact with an extractor of the weapon.

9. The system of claim 8, where the first plate or said plunger passes through a support piece of an elastic element which maintains a tension on the first plate or said plunger.

10. The system of claim 9, where the first plate or said plunger, the support piece and the elastic element are disposed in a longitudinal direction of the slide of a weapon.

11. The system of claim 1, where the first plate is an elastic element disposed in a slide of a weapon, which is in contact with a plunger which in turn is in contact with an extractor of the weapon and where the first plate or elastic element maintains a tension on the plunger as it is in contact with a support piece which is disposed inside the first plate or elastic element in the slide of the weapon, where the second plate is disposed inside the support piece.

12. The system of claim 11, where the first, plate or elastic element, the plunger, the support piece and the second plate are disposed in a longitudinal direction of the slide of a weapon.

13. The system of claim 1, where in the first position corresponding to the presence of the cartridge in the chamber, an opposing area between the first plate and the second plate is greater than in the second position corresponding to the non-presence of the cartridge in the chamber, and therefore a capacity associated to the first position is greater than a capacity associated to the second position, or where in the first position corresponding to the presence of the cartridge in the chamber, the opposing area between the first plate and the second plate is less than in the second position corresponding to the non-presence of the cartridge in the chamber, and therefore the capacity associated to the first position is less than the capacity associated to the second position.

14. The system of claim 1, where the first plate has a shape of a cylinder, whilst the second plate has a hollow cylinder shape, said second plate which is a support piece of an elastic element which maintains a tension on the first plate with said cylinder shape.

15. The system of claim 1, where in the first position corresponding to the presence of the cartridge in the chamber, the dielectric varies between the first plate and the second plate with respect to the second position corresponding to the non-presence of the cartridge in the chamber, and therefore a capacity associated to the first position is different to a capacity associated to the second position.

16. The system of claim 1, where at least the first plate or the second plate are an element belonging to a weapon.

17. The system of claim 1, where at least the first plate or the second plate are a modified element belonging to a weapon.

18. The system of claim 1, where at least the first plate or the second plate are an element external to a weapon.

19. The system of claim 1, where at least the first plate or the second plate are displaceable.

20. The system of claim 1, where at least the first plate or the second plate are fixed.

* * * * *